US006354433B1

(12) United States Patent
Mattes

(10) Patent No.: US 6,354,433 B1
(45) Date of Patent: Mar. 12, 2002

(54) MOLDED CONTAINER CAP WITH INTEGRAL RAZOR SUPPORT

(76) Inventor: Jane Mattes, 105 Bruner Ct., Pittsburgh, PA (US) 15214

( * ) Notice: Subject to any disclaimer, the term of this patent is extended or adjusted under 35 U.S.C. 154(b) by 0 days.

(21) Appl. No.: 09/659,768

(22) Filed: Sep. 11, 2000

(51) Int. Cl.[7] ..... B65D 69/00

(52) U.S. Cl. ..... 206/228; 206/349; 206/478; 248/213.2

(58) Field of Search ..... 206/228, 581, 206/576, 231, 234, 349, 478, 480, 482; 248/213.2, 309.1, 301, 308; 132/289, 290, 286; 220/212, 266, 268, 694, 729, 735; 215/228, 390, 386

(56) References Cited

U.S. PATENT DOCUMENTS

| | | | | | |
|---|---|---|---|---|---|
| 2,598,492 | A | * | 5/1952 | Boes | 206/480 |
| 4,141,445 | A | | 2/1979 | Korich | |
| D252,133 | S | | 6/1979 | Fitzgerald et al. | |
| 4,232,785 | A | | 11/1980 | Lucas | |
| 4,644,645 | A | | 2/1987 | Audet | |
| 4,646,999 | A | | 3/1987 | Clark | |
| 4,656,738 | A | | 4/1987 | Corah | |
| 4,695,029 | A | | 9/1987 | Fox et al. | |
| 4,966,294 | A | * | 10/1990 | Mack et al. | 220/266 |
| D315,306 | S | | 3/1991 | Reister | |
| 4,997,149 | A | * | 3/1991 | Koch | 248/308 |
| D389,999 | S | | 2/1998 | Daigle et al. | |
| 5,775,485 | A | * | 7/1998 | Dierking | 206/38 |
| 5,806,669 | A | | 9/1998 | Kim | |
| D409,087 | S | | 5/1999 | Casiello | |
| 6,179,259 | B1 | * | 1/2001 | Schioldager | 248/213.2 |

* cited by examiner

*Primary Examiner*—Shian Luong
(74) *Attorney, Agent, or Firm*—Richard V. Westerhoff; Eckert Seamans Cherin & Mellott, LLC

(57) ABSTRACT

An article of manufacture for storing a razor comprises a cap such as for a shaving cream container having a wall section in which are integrally molded two spaced apart arms that are pivotable about integral living hinges out of the wall section to form a yoke in which the razor is suspended. The two spaced apart arms can have separate base sections with separate living hinges or a common base section with a common living hinge. Where the cap has a cylindrical side wall and a generally flat end wall, the two spaced apart arms can extend from a living hinge in the side wall along the side wall and into the end wall so that terminal sections of the arms form an angle with the base sections. Alternatively, the arms can be formed entirely in the side wall, and if desired, have the terminal sections project toward one another to form a reentrant opening for retaining the razor. The two spaced apart arms can also be formed in dome shaped caps in which case they will curve upward when deployed to form a yoke in which the razor is supported. In another embodiment, the two arms extend circumferentially in a cylindrical wall section of the cap.

17 Claims, 2 Drawing Sheets

MOLDED CONTAINER CAP WITH INTEGRAL RAZOR SUPPORT

BACKGROUND OF THE INVENTION

1. Field of the Invention

This invention relates to storing a hand held razor between uses, and more particularly, to an arrangement in which a yoke supporting the razor is integrally molded into a container cap such as a cap for a shaving cream container.

2. Background Information

Various arrangements have been advanced for storing a razor between uses. Many propose securing the razor to a shaving cream container. Most of these employ a resilient clamp which engages the handle, or a pair of hooks on which the head of the razor rests. In both instances, the clamp or hooks project outward from the can or lid, and therefore, interfere with packing of the containers and can be broken off during shipping and handling prior to reaching the consumer. They also require additional parts to be assembled before or after shipment.

Another approach calls for molding a recess or well in the container lid in which the head of the razor is seated. A notch is provided for the handle which is also secured by a separate handle clamp. This arrangement requires a complete redesign of the container lid and is adapted for a particular razor. Generally, the clamp type holders also only accommodate razors with an appropriate configuration.

Thus, there is a need for an improved arrangement for storing razors.

More particularly, there is a need for an article for storing a razor with a container which does not interfere with packaging of the containers, is not susceptible to damage during shipping and handling, and does not require assembly of separate parts.

Another need is for an article for storing a razor which can accommodate variously sized and shaped razors.

SUMMARY OF THE INVENTION

These needs and others are satisfied by the invention which is directed to an article of manufacture for storing a razor of the type having an elongated handle and a razor head carrying a razor blade extending transversely from one end of the elongated handle. The article of manufacture comprises a molded container cap having a wall section forming two spaced apart arms pivotable about at least one integral living hinge out of the wall section to form a yoke in which the razor is supported with the razor head resting on the two spaced apart arms and the handle hanging down between the arms. The wall section of the molded cap is weakened to form the two spaced apart arms which tear away as they are pivoted about the living hinge. The two spaced apart arms can have a common base sharing a common living hinge or they can have separate bases each pivotal about a separate living hinge.

Where the molded cap has a cylindrical side wall and an integral end wall, the wall section forming the two spaced apart arms can be entirely within the side wall or it can be partly in the side wall and partly in the end wall with the living hinge in the side wall and the two spaced apart arms extending along the side wall and into the end wall. In the latter case, the terminal sections of the two spaced apart arms which are in the end wall remain at an angle to the base sections when the arms are pivoted out of the cap and therefore form hooks for supporting the razor.

In a more general sense, the molded cap can have a circular opening and the wall section forming the two spaced apart arms can be in a surface of revolution extending axially from the circular opening. Where the wall section in which the two spaced apart arms are formed is curved, the arms remain curved when pivoted about the living hinge to also form hooks. Where the wall section in which the two spaced apart arms are formed is planar, the terminal sections of the two spaced apart arms can project toward each other to form a reentrant opening for retaining the razor.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
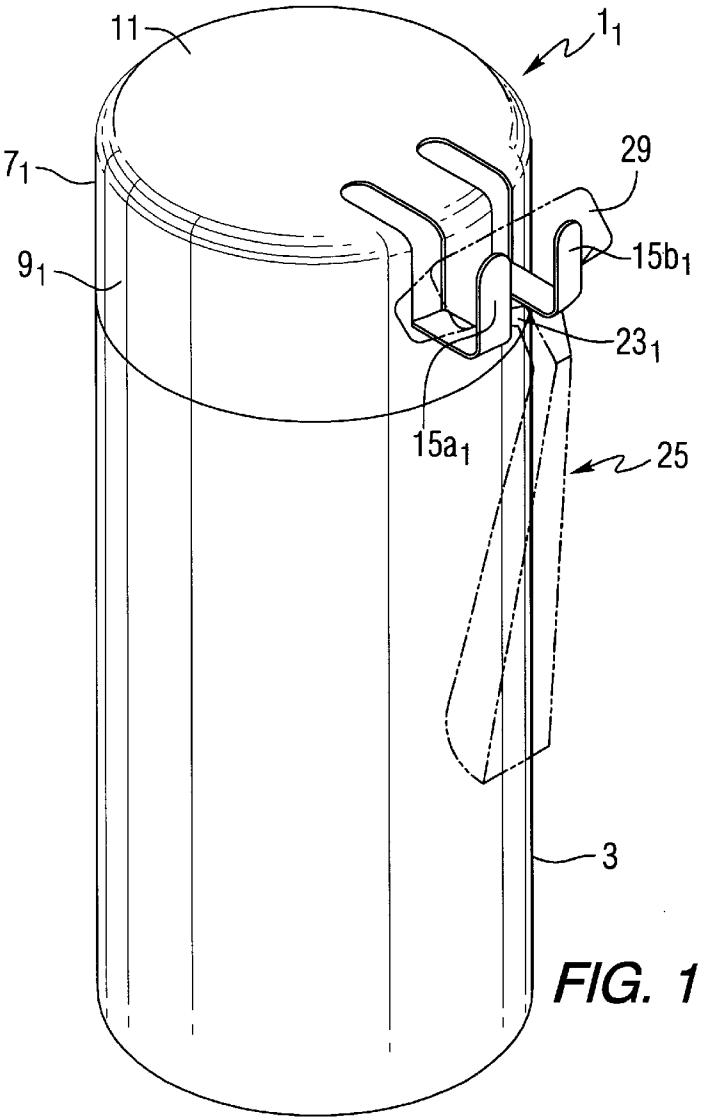
FIG. 1 is an isometric view of a shaving cream container with a cap incorporating the invention and shown deployed to hold a razor in place alongside the can.
Figure 2:
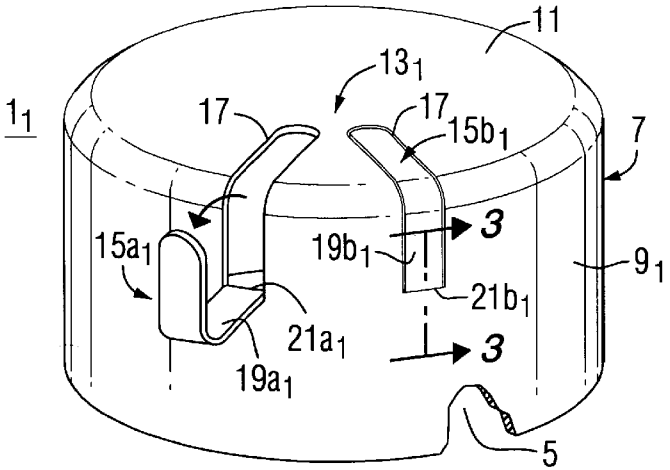
FIG. 2 is an isometric view of the lid of FIG. 1 showing one arm in the molded position and the other in the deployed position.
Figure 3:
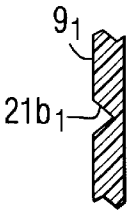
FIG. 3 is a fragmentary section through a portion of FIG. 2 taken along the line 3—3 illustrating a living hinge.

FIG. 1 illustrates an article of manufacture in accordance with the invention in the form of a cap $\mathbf{1}_1$ for a container 3 for shaving cream. The cap $\mathbf{1}_1$ is molded of a plastic resin as is well known. As better shown in FIG. 2, the cap $\mathbf{1}_1$ has a circular opening 5 in a wall $\mathbf{7}_1$ forming a surface of revolution about the circular opening. In the cap of FIG. 2 this surface of revolution forms a cylindrical side wall $\mathbf{9}_1$ and generally flat end wall 11. Within a region $\mathbf{13}_1$ of the wall $\mathbf{7}_1$ is formed a pair of spaced apart arms $\mathbf{15}a_1$ and $\mathbf{15}b_1$. These arms $\mathbf{15}a_1$ and $\mathbf{15}b_1$ are defined by a weakened areas in the wall section $\mathbf{13}_1$ such as the score lines 17. Base sections $\mathbf{19}a_1$ and $\mathbf{19}b_1$ of the arms $\mathbf{15}a_1$ and $\mathbf{15}b_1$ are pivotally connected to the wall section $\mathbf{13}_1$ by integral living hinges $\mathbf{21}a_1$ and $\mathbf{21}b_1$. A cross section through the living hinge $\mathbf{21}b_1$ is shown in FIG. 3. Such living hinges are well known to plastic molders.

The cap $\mathbf{1}_1$ is molded with the two arms $\mathbf{15}a_1$ and $\mathbf{15}b_1$ integral with the side wall $\mathbf{9}_1$ and end wall 11 as shown in the case of the arm $\mathbf{15}b_1$ in FIG. 2. The two arms $\mathbf{15}a_1$ and $\mathbf{15}b_1$ are deployed by applying pressure to them such as by removing the cap and pressing on the arms from the inside. This tears the arms $\mathbf{15}a_1$ and $\mathbf{15}b_1$ along the score lines 17 so that the arms pivot about the living hinges $\mathbf{21}a_1$ and $\mathbf{21}b_1$ to the position shown by the arm $\mathbf{15}a_1$ in FIG. 2 and by both arms in FIG. 1. With both arms $\mathbf{15}a_1$ and $\mathbf{15}b_1$ pivoted to the deployed position, a yoke $\mathbf{23}_1$ is formed in which a razor 25 can be supported. The razor 25 has an elongated handle 27 and a razor head 29 carrying a razor blade (not shown) extending transversely from one end. The razor 25 is inserted into the yoke so that the razor head 25 rests on the arms $\mathbf{15}a_1$ and $\mathbf{15}b_1$ and the handle 27 extends between the arms and hangs down along side of the container 3.

As can be appreciated, prior to deployment of the arms 15$a_1$ and 15$b_1$, the cap 1$_1$ has the smooth outer configuration of an ordinary container cap. There are no projections which can break off or preclude close packing for shipping. Also, there are no additional parts that need to be assembled. The two spaced apart arms only need to be torn from the cap and rotated about their living hinges. When not in use or for travel, the two arms 15$a_1$ and 15$b_1$ can be pushed back into their molded position. No additional parts need to be assembled. The score lines are formed by minor tooling of existing cap molds.

Figure 4:
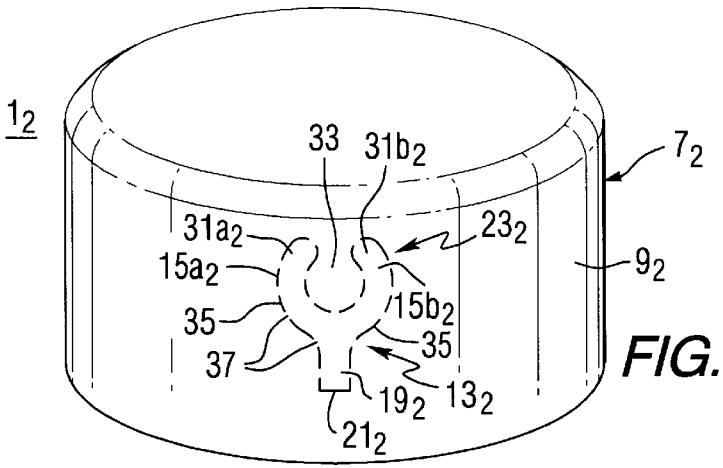
FIG. 4 is an isometric view of a cap in accordance with another embodiment of the invention.

FIG. 4 illustrates another embodiment of the invention in which the section 13$_2$ of the wall 7$_2$ of the cap 1$_2$ is entirely within the side wall 9$_2$. In addition, the two spaced apart arms 15$a_2$ and 15$b_2$ have a common base section 19$_2$ with a common living hinge 21$_2$. As the terminal ends 31$a_2$ and 31$b_2$ of the arms 15$a_2$ and 15$b_2$ are in the same plane as the common base 19$_2$, these terminal ends 31$a_2$ and 31$b_2$ can project toward each other to form a yoke 23$_2$ with a reentrant opening 33 for better grasping and retaining the razor. The arms 15$a_2$ and 15$b_2$ and the common base 19$_2$ are formed in the wall section 13 by cuts 35 which extend all the way through the wall. The two arms 15$a_2$ and 15$b_2$ can be retained in place until use by small frangible bridges 37 which tear away when pressure is applied.

Figure 5:
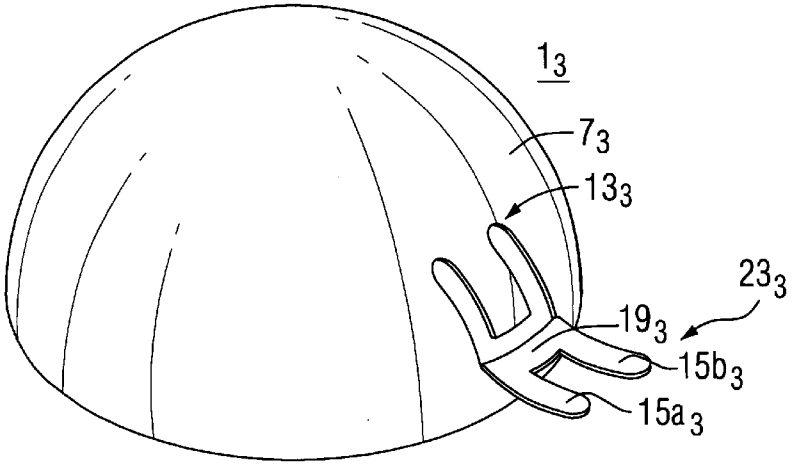
FIG. 5 is an isometric view of yet another embodiment of the invention.

Yet another embodiment of the invention is shown in FIG. 5. The surface of revolution 7$_3$ here forms a hemisphere or other curved surface of the cap 1$_3$. As the section 13$_3$ of the wall 7$_3$ in which the arms 15$a_3$ and 15$b_3$ are formed is curved, these arms are also curved. This causes the arms to curve upward when deployed to form the yoke 23$_3$. Again, the two arms 15$a_3$ and 15$b_3$ can have separate base sections with separate living hinges or share a common base 193 with a common living hinge 21$_3$ as shown in FIG. 5.

Figure 6:
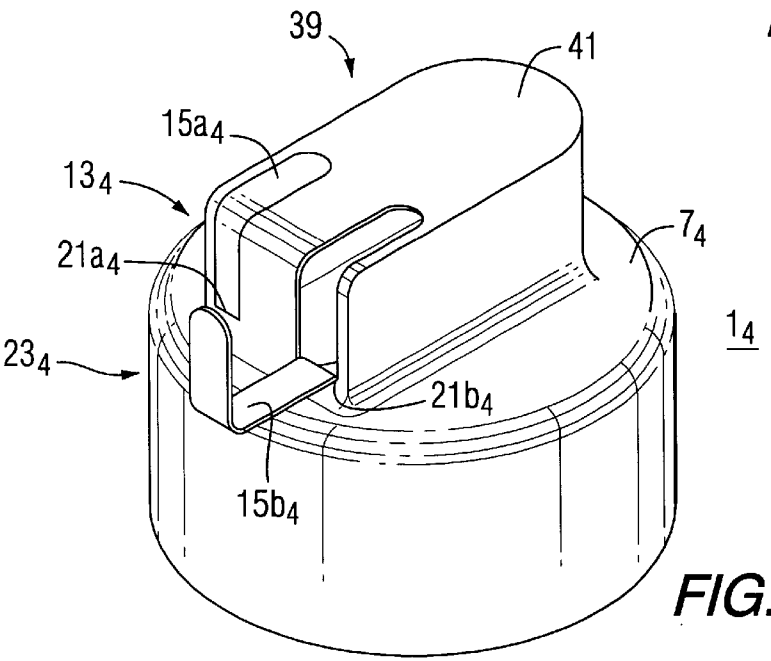
FIG. 6 is an isometric view of an additional embodiment of the invention.

FIG. 6 illustrates adaptation of the invention to a shaving cream can cap 1$_4$ having a narrow shaped section 39 formed by the wall 7$_4$. The section 13$_4$ extends axially up the narrow shaped section 39 and into a flat end section 41 so that the two arms 15$a_4$ and 15$b_4$ extend upward in the shaped section 39 and then at an angle in the flat top section 41. When both of these arms are rotated about their respective living hinges 21$a_4$ and 21$b_4$ they form the yoke 23$_4$.

Figure 7:
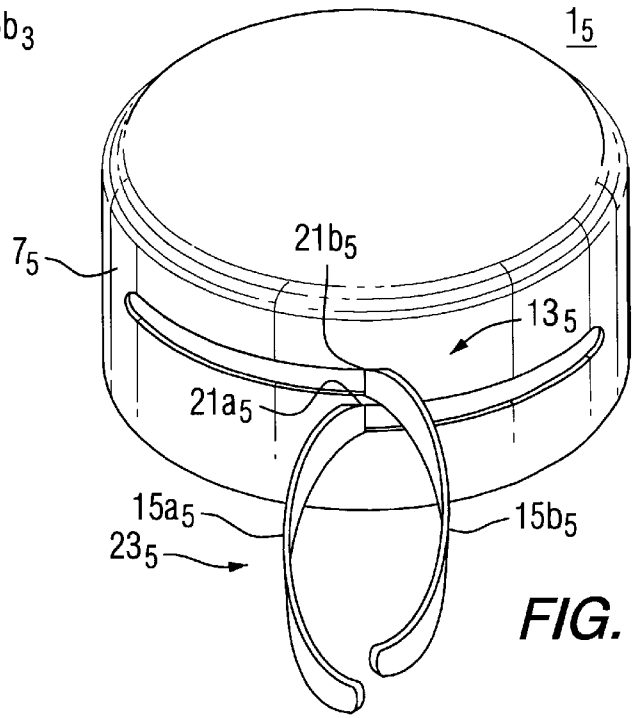
FIG. 7 is an isometric view of still another embodiment of the invention.

Yet another embodiment of the invention is shown in FIG. 7. In this embodiment, the arms 15$a_5$ and 15$b_5$ extend circumferentially in opposite directions about the cylindrical section 13$_5$ of the wall 7$_5$ of the cap. They are thus curved so that when they are rotated about their respective living hinges 21$a_5$ and 21$b_5$, which are preferably axially aligned, the two arms curve toward one another to form the yoke 23$_5$.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An article of manufacture for storing a razor having an elongated handle and a razor head carrying a razor blade extending transversely from one end of the elongated handle, the article of manufacture comprising:

a molded container cap having a wall section forming two spaced apart arms pivotable about integral living hinge means out of the wall section to form a yoke in which the razor is supported with the razor head resting on the two spaced apart arms and the handle passing between the two spaced apart arms, the wall section being weakened to form the two spaced apart arms which tear away as they are pivoted about the living hinge means.

2. The article of manufacture of claim 1 wherein the wall section is severed to form the two spaced apart arms which are connected to the remainder of the wall section by frangible bridges.

3. The article of manufacture of claim 1 wherein the two spaced apart arms have a common base with a common living hinge forming the hinge means.

4. The article of manufacture of claim 1 wherein the two spaced apart arms have separate bases each pivotable about a separate living hinge forming the hinge means.

5. The article of manufacture of claim 1 wherein the molded cap has a cylindrical side wall and an end wall integral with the side wall, the wall section forming the two spaced apart arms being entirely within the side wall.

6. The article of manufacture of claim 1 wherein the molded cap has a circular opening and the wall section forming the two spaced apart arms is in a surface of revolution extending generally axially from the circular opening.

7. The article of manufacture of claim 6 wherein the surface of revolution includes a side wall and an end wall and wherein the wall section forming the two spaced apart arms is entirely in the side wall.

8. The article of manufacture of claim 7 wherein terminal sections of the two spaced apart arms project toward each other to form a reentrant opening between the two spaced apart arms.

9. The article of manufacture of claim 7 wherein the wall section in which the two spaced apart arms are formed is curved so that the two spaced apart arms are curved.

10. The article of manufacture of claim 9 wherein terminal sections of two spaced apart arms project toward each other to form a reentrant opening between the two spaced apart arms.

11. The article of manufacture of claim 7 wherein the two spaced apart arms extend axially in the side wall.

12. The article of manufacture of claim 7 wherein the two spaced apart arms extend circumferentially in opposite directions in the side wall and are spaced apart axially.

13. The article of manufacture of claim 12 wherein the side wall is cylindrical and the living hinge means comprises separate substantially axially aligned living hinges for the two spaced apart arms.

14. The article of manufacture of claim 6 wherein the surface of revolution includes a side wall extending from the circular opening and an end wall integral with the side wall, the living hinge means being located in the side wall and the two spaced apart arms extending along the side wall and into the end wall.

15. The article of manufacture of claim 1 wherein the molded cap has a narrow shaped section containing the wall section in which the two spaced apart arms are formed.

16. The article of manufacture of claim 15 wherein the narrow shaped section has an axial side and an end section and the wall section in which the two spaced apart arms are formed extends up the axial side of the narrow shaped section and into the end section.

17. An article of manufacture for storing a razor having an elongated handle and a razor head carrying a razor blade extending transversely from one end of the elongated handle, the article of manufacture comprising:

a molded container cap having a wall section forming two spaced apart arms pivotable about integral living hinge means out of the wall section to form a yoke in which the razor is supported with the razor head resting on the two spaced apart arms and the handle passing between the two spaced apart arms, the molded cap having a cylindrical side wall and an end wall integral with the side wall, and wherein the two spaced apart arms extend along the side wall into the end wall so that the two spaced apart arms have terminal sections molded at an angle with base sections.

* * * * *

UNITED STATES PATENT AND TRADEMARK OFFICE

CERTIFICATE OF CORRECTION

PATENT NO. : 6,354,433 B1
DATED : March 12, 2002
INVENTOR(S) : Jane Mattes

It is certified that error appears in the above-identified patent and that said Letters Patent is hereby corrected as shown below:

Column 3,
Line 33, "193" should read -- $19_3$ --.

Signed and Sealed this

Twenty-seventh Day of August, 2002

*Attest:*

*Attesting Officer*

JAMES E. ROGAN
*Director of the United States Patent and Trademark Office*